United States Patent [19]

Franek et al.

[11] Patent Number: 4,483,171

[45] Date of Patent: Nov. 20, 1984

[54] METAL CAN BODIES

[75] Inventors: Jozef T. Franek, Chorleywood; Paul Porcuznik, St. Albans, both of England

[73] Assignee: Metal Box PLC, Reading, England

[21] Appl. No.: 451,158

[22] PCT Filed: Apr. 13, 1982

[86] PCT No.: PCT/GB82/00111

§ 371 Date: Dec. 7, 1982

§ 102(e) Date: Dec. 7, 1982

[87] PCT Pub. No.: WO82/03576

PCT Pub. Date: Oct. 28, 1982

[30] Foreign Application Priority Data

Apr. 22, 1981 [GB] United Kingdom ..... 8112489

[51] Int. Cl.[3] ..... B21D 22/00

[52] U.S. Cl. ..... 72/347; 72/470

[58] Field of Search ..... 72/347, 348, 349, 470

[56] References Cited

U.S. PATENT DOCUMENTS

| | | | |
|---|---|---|---|
| 814,054 | 3/1906 | Lamb | 72/347 |
| 3,820,369 | 6/1974 | Tominaga et al. | 72/57 |
| 4,157,693 | 6/1979 | Openchowski | 72/348 |

*Primary Examiner*—Leon Gilden

*Attorney, Agent, or Firm*—Berman, Aisenberg & Platt

[57] ABSTRACT

A method of, and apparatus for, forming a tapered-wall metal can body by drawing. The method includes the steps of: (a) producing a metal can body blank (64) comprising a smooth generally cylindrical wall (66), an integral base (68) at one end of said wall, and a trimmed free rim (70) exposed at the opposite, open end of said wall, said rim being generally normal to said wall; (b) advancing the can body blank, base first, into a die (42) (hereafter the 'tapered die') by means of a punch (18) engaged inside the blank with only the base of said blank, so as to bring the said wall progressively into greater contact with a tapered internal working surface (44) of the die; (c) simultaneously with the step (b) applying longitudinal pressure, as well as transverse restraint, to the exposed free rim of the said wall by means of a pressure collar (28) whereby to urge the blanks squarely into the tapered die, and maintaining at least that pressure, and restraint, as the blank is advanced progressively further into said tapered die; and (d) continuing the advancement of said blank by continued advancement of said punch and simultaneous application of said longitudinal pressure, and transverse restraint, to said rim, until the said wall lies uniformly against said working surface of said die throughout a desired longitudinal length of said wall.

24 Claims, 12 Drawing Figures

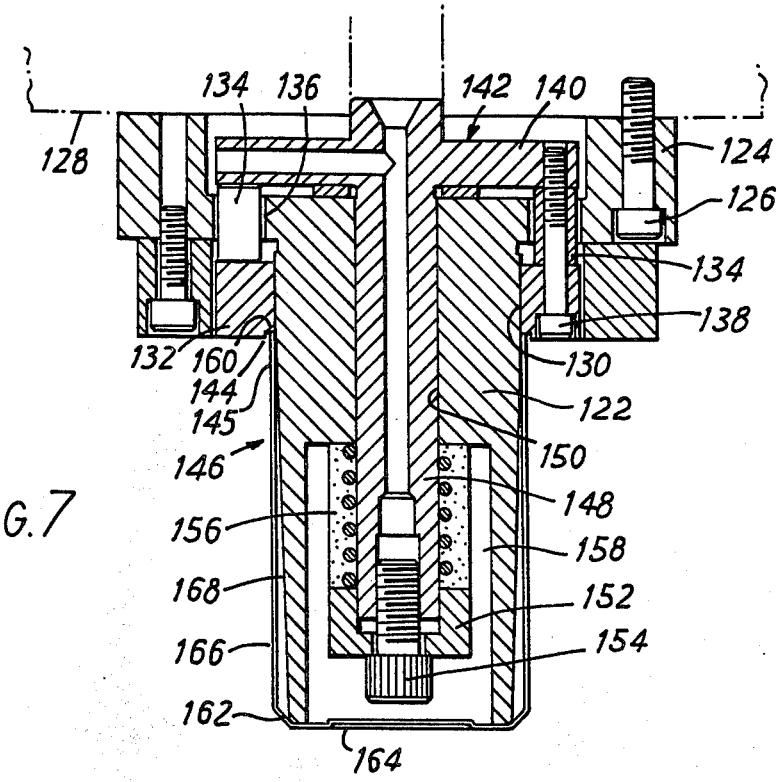
FIG. 7
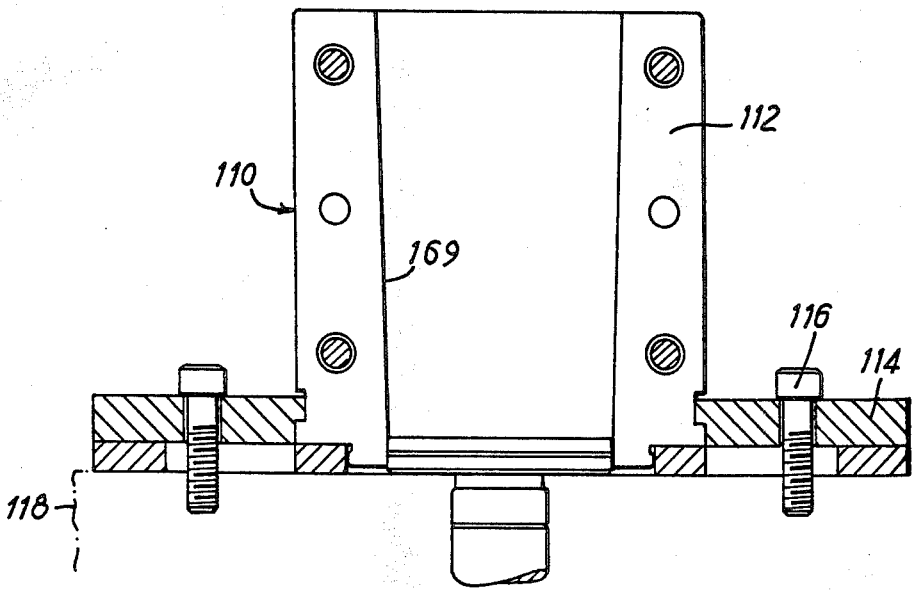

METAL CAN BODIES

This invention relates to metal can bodies in the form of a cup, i.e. bodies comprising a generally cylindrical wall (of circular or other transverse cross-section) and an integral base at only one end of said wall, and to a method and apparatus for manufacturing such can bodies.

Such can bodies having said wall formed with a small taper longitudinally (i.e. said wall bounds a frustum of a cone) are known, and have substantial advantages so far as storage and transport are concerned, since such tapered can bodies can be nested together, each can body then being largely enclosed within the next can body.

However, the successful manufacture of such tapered can bodies has been difficult to achieve. Many tool systems for the drawing of tapered can bodies have been proposed and tried. Most such systems have combined taper drawing with straight redrawing in the same tool, and some of them have employed expanding mandrels, or expanding dies. In most cases, however taper drawing has resulted in badly wrinkled and/or creased tapered walls. To some extent an expanding mandrel made from an elastic material has prevented wrinkled formation, but only at the expense of rather low production rates, and short tool life.

Use of the word "taper" or any derivative thereof as a noun, adjective or verb hereinafter in respect of a can body, workpiece or tool element, means, to the extent allowed by the context, that the cross-sectional area decreases (while maintaining its symmetry with respect to a central axis) over a major part of the length of the tool element, or of the can body or workpiece from the open end thereof, as the case may be.

The present invention seeks to provide a method and tooling system for the taper redrawing, in a separate operation, of a cylindrical walled can body (for forming a two-piece can) made from low gauge material; and, moreover, to provide such a method and tool system which will cover all can proportions, including those cases where the height exceeds the diameter, and where the taper angle is kept to a minimum (i.e. below 3°) but is sufficient to ensure the desired nesting density of can bodies, i.e. in which the longitudinal separation of the respective can bodies is of the order of 10 mm.

According to a first aspect of the present invention a method of forming a tapered-wall metal can body by drawing includes the steps of:

(a) producing a metal can body blank comprising a smooth generally cylindrical wall, an integral base at one end of said wall, and a trimmed free rim exposed at the opposite, open end of said wall, said rim being generally normal to said wall;

(b) advancing the can body blank, base first, into a die (hereafter the "tapered die") by means of a punch engaged inside the blank with only the base of said blank, so as to bring the said wall progressively into greater contact with a tapered internal working surface of the die;

(c) simultaneously with the step (b) applying longitudinal pressure, as well as transverse restraint, to the exposed free rim of the said wall whereby to urge the blank squarely into the tapered die, and maintaining at least that pressure, and restraint, as the blank is advanced progressively further into said tapered die; and (d) continuing the advancement of said blank by continued advancement of said punch and simultaneous application of said longitudinal pressure, and transverse restraint, to said rim, until the said wall lies uniformly against said working surface of said die throughout a desired longitudinal length of said wall.

By exercising a proper control over the ratio of the respective pressures applied to the can body blank at its base, by said punch, and at its exposed free rim, it has been found possible to produce can bodies which are substantially free from all wrinkling and creasing.

Preferably, said can body blank has a said integral base which merges gradually into said cylindrical wall, preferably by means of a short tapered section.

Said tapered internal working surface of said die may in some cases by constituted by a series of successive sections of which the respective cross-sectional areas transverse to the direction of advancement of said blank in said die decrease progressively from one said section to the next in the direction of advancement of said blank into said die.

Each said section of said internal working surface may be constituted as a cylindrical surface element which is joined to each adjacent such surface element by a step.

According to a second aspect of the present invention an apparatus for performing a method as referred to above comprises:

(a) a said tapered die having a said tapered internal working surface extending longitudinally therein;

(b) a said punch for receiving and advancing said blank longitudinally into said tapered die, said punch being arranged to engage internally of said blank with only said base of said blank;

(c) driving means for effecting relative advancement of said die and said punch whereby to effect advancement of a said blank received on said punch into progressively greater contact with said internal working surface of said die; and (d) pressure-appying means associated with said punch for applying, when in operation, a longitudinal pressure, and a transverse restraint, to the said exposed free rim of a said can body blank received on said punch as said punch is advanced longitudinally to move said can body blank into the tapered die, said pressure-applying means being operative to maintain said pressure, and restraint, until said relative advancement of said punch and die is terminated at a time when said wall of said blank lies uniformly against said internal working surface of said die throughout a desired length of said wall.

Said pressure-applying means preferably comprises a collar arranged for longitudinal sliding on said punch, said collar having a rim supporting surface for receiving and supporting a said exposed free rim of a said can body blank when received on said punch, and collar supporting means for supporting said collar at a longitudinal position on said punch such that when said exposed free rim of a can body blank is seated on and supported by said rim supporting surface prior to advancement of said blank into said die, said punch abuts internally against said integral base of said blank.

Advantageously, said collar supporting means includes a resilient biasing means which becomes progressively compressed by said collar as the unch advances a said blank into said tapered die, thereby causing said longitudinal pressure applied to said exposed free rim of said blank to progressively increase as said punch advances into said die.

Preferably, said apparatus also includes a blank-clamping member slidably mounted relative to said die for axial movement through the tapered bore of said die, and biasing means urging said clamping member to a biased position disposed at the entrance to said die, whereby on relative movement of said die and punch to advance a can body blank into the bore of said die, said clamping member urges the base of a said blank received on said punch against the nose of said punch and thereby holds said base firmly during the drawing of the wall of said blank in said die.

Said tapered internal working surface of said die may in some cases be divided into a series of longitudinally successive sections of which the cross-sectional areas transverse to the direction of advancement of said blank in said die decrease progressively from one such section to the next in the said direction of advancement of said blank.

According to a third aspect of the present invention there is provided a one-piece metal can body having a side wall defining an open end, and a closed end integral with the side wall, in which can body the overall cross-sectional area of the can body decreases over a major part of the length of the side wall in the direction towards the closed end, and the side wall is formed with a generally frusto-conical step nearer to the closed end than to the open end, the step being convergent towards the closed end.

In a preferred form of such can body, the side wall is in the form of a series of cylindrical portions each of which is joined to the next, in the direction towards the closed end, by a generally frusto-conical step convergent towards the closed end.

The methods and apparatus according to the present invention are primarily intended for producing can bodies of which the transverse cross-sectional shape is of, or approximates to, a circular configuration. However, those methods and apparatus may be used for producing can bodies of other transverse cross-sectional shapes, for example polygonal shapes.

Other features and advantages of the present invention will appear from the description that follows hereafter, and from the claims appended at the end of that description.

Various forms of apparatus according to the present invention for carrying out the various methods of the present invention, and those methods, will now be described by way of example and with reference to the accompanying drawings, in which:

FIG. 7 shows a vertical cross-section of an alternative form of can body forming apparatus, with a cylindrical can body blank mounted on a punch in readiness for commencement of the drawing operation;

Figure 12:
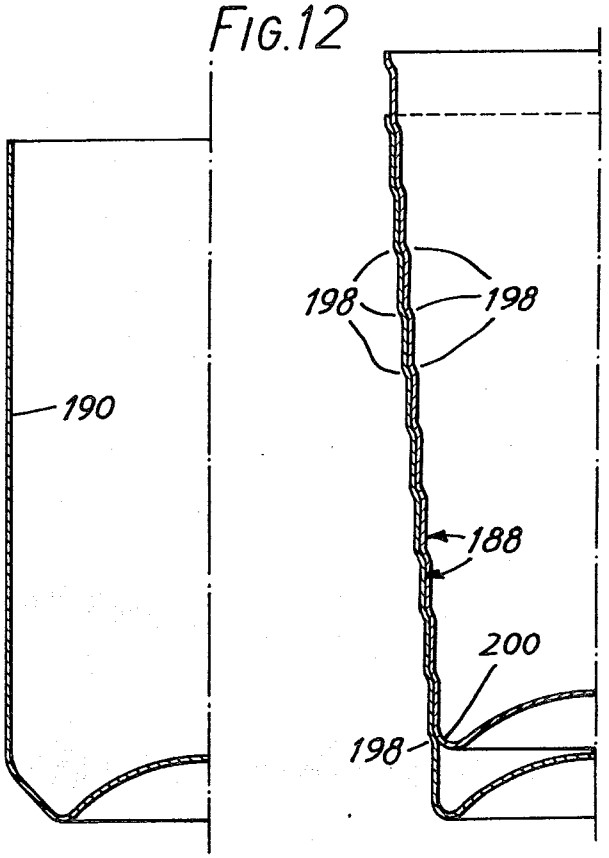
Figure 11:
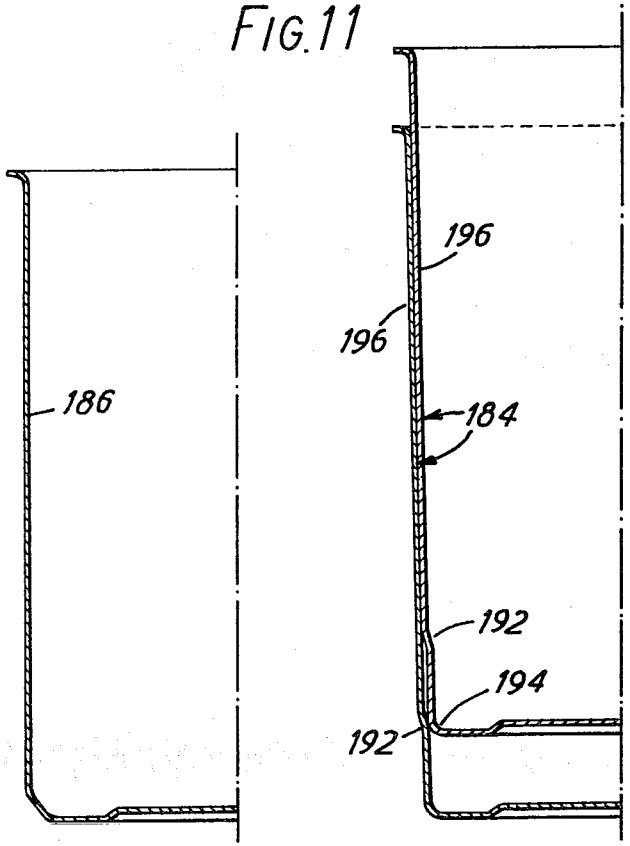

FIG. 11 shows side by side vertical cross-sections of one can body blank ready for drawing, and the same blank after drawing, and with a second, similar can body nested within it, the right hand halves of the sections being omitted for convenience; and FIG. 12 shows side by side vertical cross-sections of another can body blank ready for drawing, and of the same blank after drawing and with a second, similar can body nested within it, the right hand halves of the sections being omitted for convenience.

Referring now to the apparatus shown in the FIGS. 1 to 6, a punch assembly 10 is securely mounted on a stationary base member (not shown) of a press tool, directly beneath a movable die assembly 12, which is itself carried on a vertical shaft 14 slidably carried in an overhead frame member 16 of the press.

The punch assembly 10 comprises a central vertical punch 18 which is upstanding from a fixed, cylinder end plate 20, and which is enclosed within a cylinder wall 22 which is open at its upper end. Around the lower end of the punch is disposed a biasing compression spring 24, and slidably carried in a pressure-tight manner on the punch is a piston 26 whose outer periphery engages in a pressure-tight manner with said cylinder wall 22. Also slidably carried on said punch and secured in an upper part of said piston is a pressure collar 28 which is retained in position on said piston by retaining ring 30.

Slidably mounted around the upper end of said pressure collar is a vertically displaceable guide ring 32 having upwardly extending guide fingers 34, whose purpose will become apparent later.

The guide ring is biased to its uppermost position by compression springs 36.

The movable die assembly 12 includes an upper end plate 38 secured at the lower end of said shaft 14 and from which depend spacer members 40 which support at the lower end a die 42 having a smooth tapered internal working surface 44 in the shape of the surface of a frustum of a cone.

Extending longitudinally through the centre of the die assembly 12 is a blank-clamping assembly 46. The latter includes a central rod 48 which is slidably carried at its upper end in a longitudinal bore in said shaft 14, and which carries slidably mounted at its lower end a transverse clamping member 50 of inverted cup shape. The latter is spaced by a resilient annular bush 52 from a transverse travel-limiting member 54 which is itself securely carried on the central rod 48 just below a shoulder 56 thereof. Trapped on that rod between that transverse member 54 and a shoulder 58 formed in the vertical shaft 14 is a helical compression spring 60. The latter spring urges the transverse member 54 into contact with the upper face of the die 42, and hence determines a biased position of said clamping cup 50 in relation to the die 42. The latter carries at its lower face downwardly extending blank-guiding fingers 62 whose purpose will become apparent later.

Figure 1:
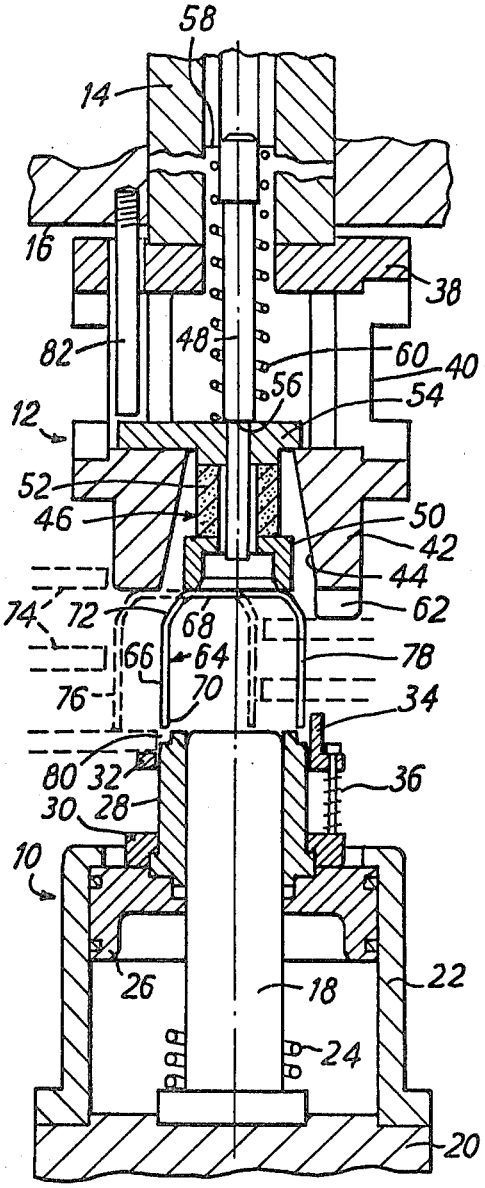
FIGS. 1 to 6 show similar vertical cross-sections of one can body forming apparatus for producing smooth-wall tapered can bodies, the respective figures showing the apparatus at different stages in its cycle of operation.

The condition of the apparatus at the beginning of a cycle of operation is that shown in FIG. 1. The apparatus is intended to receive and work with a supply of metal can body blanks 64 each of which comprises a smooth cylindrical wall 66 of uniform annular transverse cross-section having at one end an integral transverse base 68, and exposed at its opposite end a trimmed free rim 70, which rim is normal to said cylindrical wall.

Said integral base merges with said cylindrical wall through a tapered (i.e. frusto-conical) intermediate section 72 of the can body.

Can bodies of that description are fed successively to the apparatus from the left-hand side (as seen in FIG. 1) along fixed guides by a turret feeder the relevant parts of which are represented in dotted form at 74 in FIG. 1. In that figure a can body blank is represented for convenience by its central vertical cross-section only, the dotted form 76 thereof indicating a blank being fed into the apparatus, and the solid line form 78 thereof indicating a blank delivered to the cycle-starting position, in vertical alignment with the die and punch assemblies.

In the starting condition of FIG. 1, the piston 26 and associated pressure collar 28 are held in their uppermost positions by compressed air admitted below that piston.

Figure 2:
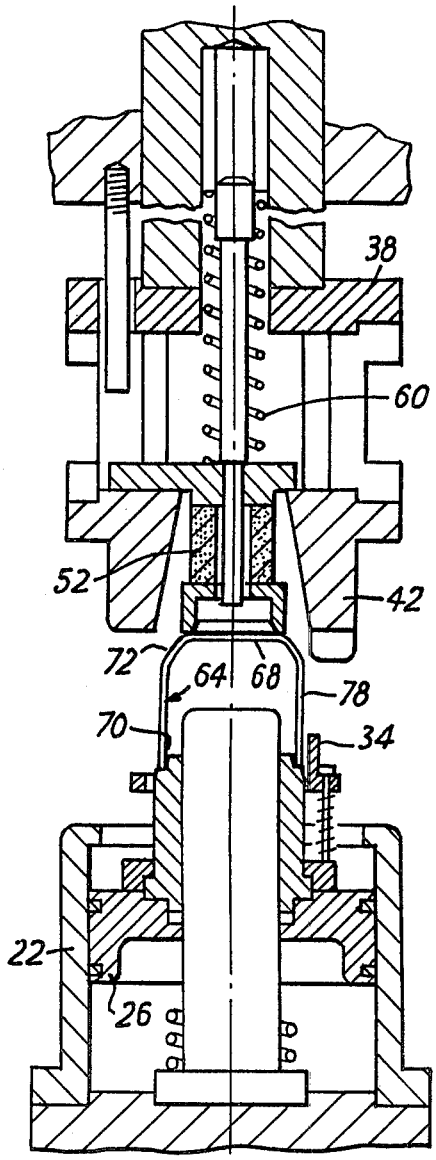
Figure 3:
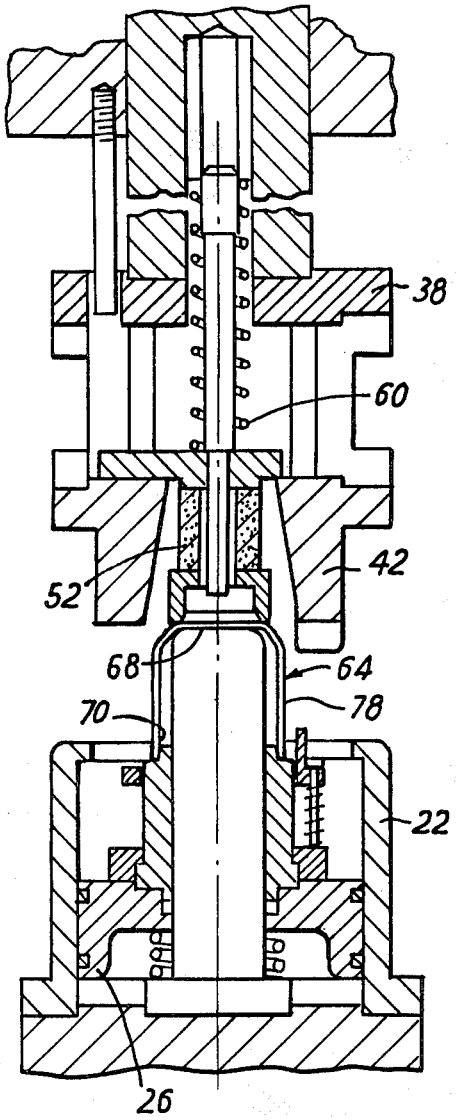
Figure 4:
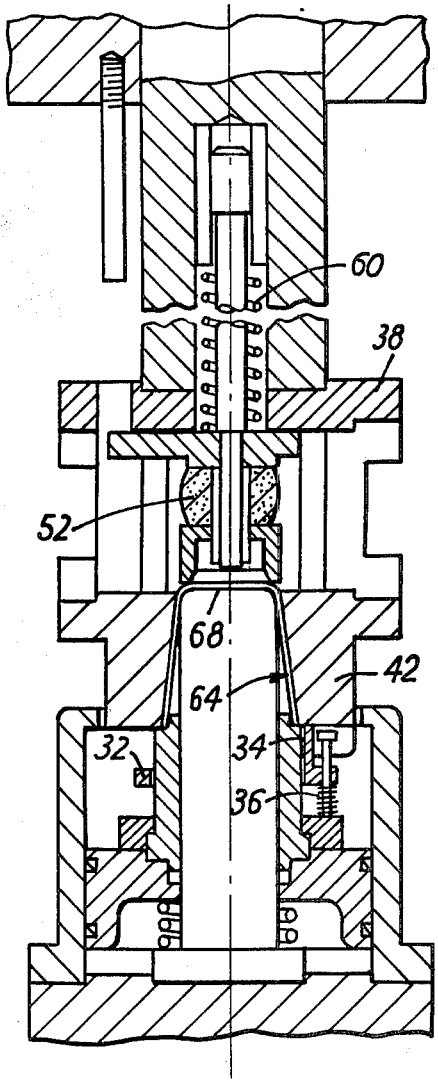

The can body is then formed by progressively lowering the shaft 14 and its associated die assembly 12 as indicated in the successive FIGS. 2 to 4, to firstly press the blank 78 by means of the clamping cup 50 and biasing spring 60 on to an annular seat 80 formed around the upper part of the pressure collar 28, so that the said free rim exposed at the bottom of the blank is firmly seated on the collar and thereby transversely located relative to the punch 18.

With continued downward movement of the die assembly, the clamping cup depresses the pressure collar and the associated piston against the resistance of the charge of compressed air trapped below that piston.

FIG. 2 depicts the condition of the apparatus with the said piston depressed to an intermediate position in its stroke, and the clamping cup still in its lowermost, bias position.

FIG. 3 shows the condition when the piston 26 has been brought into contact with the compression spring 24, so that the base 68 of the can body is then firmly gripped between the nose of the punch 18 and the rim of the clamping cup 50.

Further continued downward movement of the shaft 14 progressively lowers the die assembly 12 even though the clamping cup can descend no further, and the resilient bush 52 is thus compressed by an increasing load generated by the progressive compression of the spring 60 through a downward movement of the step 58 in the bore of the descending shaft 14. As a result, the base of the blank is held in position with progressively increasing pressure. With such continued downward movement of the die assembly, a position is reached in which the tapered internal working surface 44 of the die contacts the peripheral part of the blank at the junction of said cylindrical wall 66 with said intermediate section 72, so that the said cyindrical wall is subjected to a frictional downward thrust which is resisted by the reaction of the pressure collar 28 and its associated compression spring 24. Said thrust provides circumferentially downwardly-acting forces tending to draw the metal of the said intermediate section of the can body blank, and to change the shape thereof so as to align a progressively lengthening section of the upper wall part of the blank against the tapered internal working surface of the die. At the same time the reaction of the pressure collar urges the cylindrical wall of the blank upwardly, with progressively increasing pressure, against the tapered working surface of the die, so that the wall material is fed positively, and tangentially (as seen in the figures), on to, and slides along, that working surface, said material being compressed circumferentially and yieldingly by a compressive hoop stress so as to reduce the diameter of the body wall as the body wall advances into the tapered die.

The combination of tensile forces induced in the body wall material by the advancement of the punch nose, and the controlling compressive forces induced by the pressure collar, when correctly adjusted to suit (a) the material and proportions of the desired can body, and (b) those of the blank, enables the production of tapered can bodies free of wrinkles and creases.

Tests have indicated that the magnitude of the compressive forces induced by the pressure collar can be up to 40% of the axial tensile force applied by the punch nose.

The downward advancement of the die assembly continues until the can body has been fully formed within the die, as shown in the FIG. 4.

Completion of the downward stroke of the die assembly is followed by an upward return stroke. During that stroke the die lifts off the outer surface of the formed can body whilst that body is still held captive by its base trapped between the clamping cup and the nose of the punch. Eventually the clamping cup likewise lifts off the can body base, i.e. after the resilient annular bush 52 loses its compression.

Figure 5:
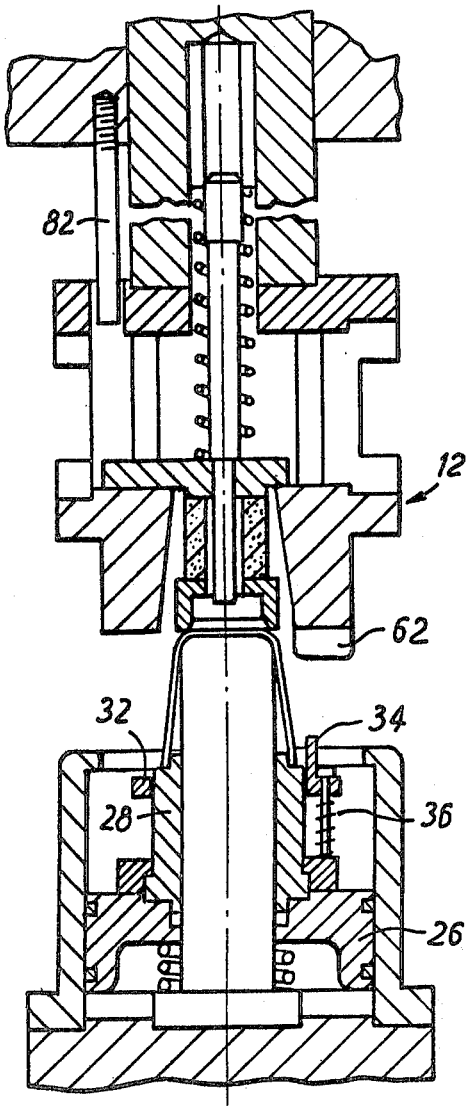

In FIG. 5 the apparatus is shown in the condition when the die assembly is parting company with the newly formed tapered can body.

Figure 6:
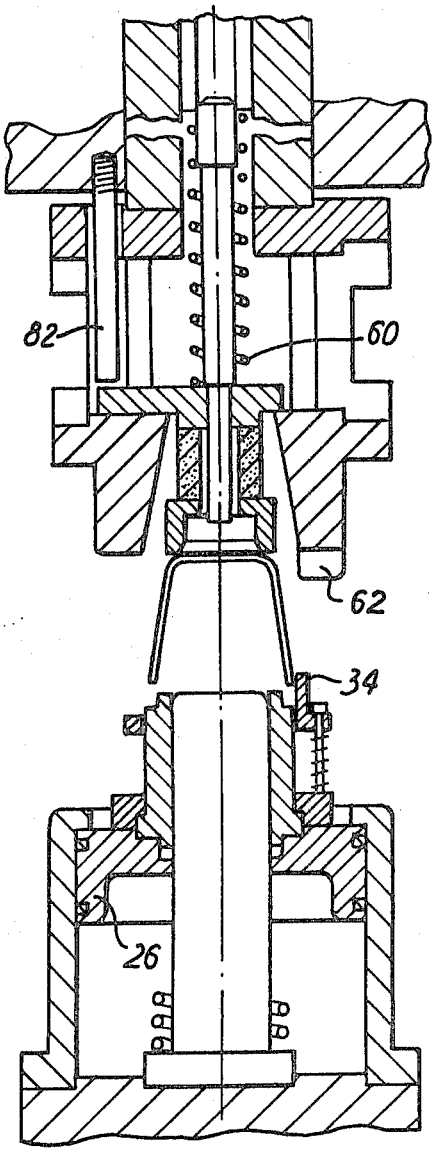

In FIG. 6 the piston 26 has been raised to its upper position by the admission of compressed air to its underside, and the tapered can body is shown separated (by its momentum gained during the upward movement of the pressure collar) from the pressure collar and then arrested by the clamping cup. The newly formed tapered can body is steadied by the guide fingers 34 and 62.

Those guide fingers serve to position and steady the can body blank both during its initial positioning between the die and punch assemblies, and again after formation of the tapered can body and pending its removal to another station by an exit turret (not shown).

A positive knock-out member 82 is provided on the upper frame member 16, and this projects through apertures formed in the die assembly 12, when the latter is in its uppermost position, so as to effect a positive ejection of the formed can body from the die in the rare event that the compression spring 60 of the clamping assembly fails to eject the can body on upward movement of the die assembly.

It should be noted that during the final downward travel of the die assembly to form the can body, the guide ring 32 and fingers 34 carried around the pressure collar 28 are depressed by the die assembly against the action of the biasing spring 36.

In an alternative apparatus as shown in FIG. 7, a fixed die assembly 110 comprises a split tapered die 112 secured by a collar 114 and screws 116 to a press base 118, and a reciprocable punch assembly 120 comprises a tapered punch 122 secured by an integral mounting flange 124 and screws 126 to a crosshead 128 of the press.

The punch carries around an upper parallel-sided cylindrical part 130 thereof a pressure collar 132 which is secured through tappets 134 extending through axial holes 136 in the mounting flange 124 of the punch and by associated screws 138 to a disc portion 140 of a mushroom-shaped member 142.

The pressure collar 132 has an annular recess 144 adjacent the periphery of the punch 122 for receiving the exposed free rim 145 of a can body blank 146, which blank is shown in vertical transverse cross-section only in the figure. A stalk portion 148 of the mushroom-shaped member 142 extends downwardly through a vertical bore 150 of the punch, and carries at its lower end a retaining ring 152 which is secured by a screw 154 and which retains on the lower end of the stalk portion 148 a biasing spring 156, the upper end of which abuts the upper end of a counter-bore 158 formed in the punch for the purpose of housing said spring.

In this arrangement, at the start of the can body forming operation the exposed free rim 145 of a can body blank 146 rests on an annular seat 160 of the pressure collar in said recess 144, and the upward thrust of the can wall on the pressure collar as the can wall extends in length is resisted by the force of the bias spring 156 applied to the pressure collar 132 through the mushroom-shaped member 142 and the tappets 134. As before the can body blank has a tapered intermediate section 162 joining the base 164 and the cylindrical wall 166. The punch in this instance has a frusto-conical outer surface 168 to complement that of the die.

Figure 8:
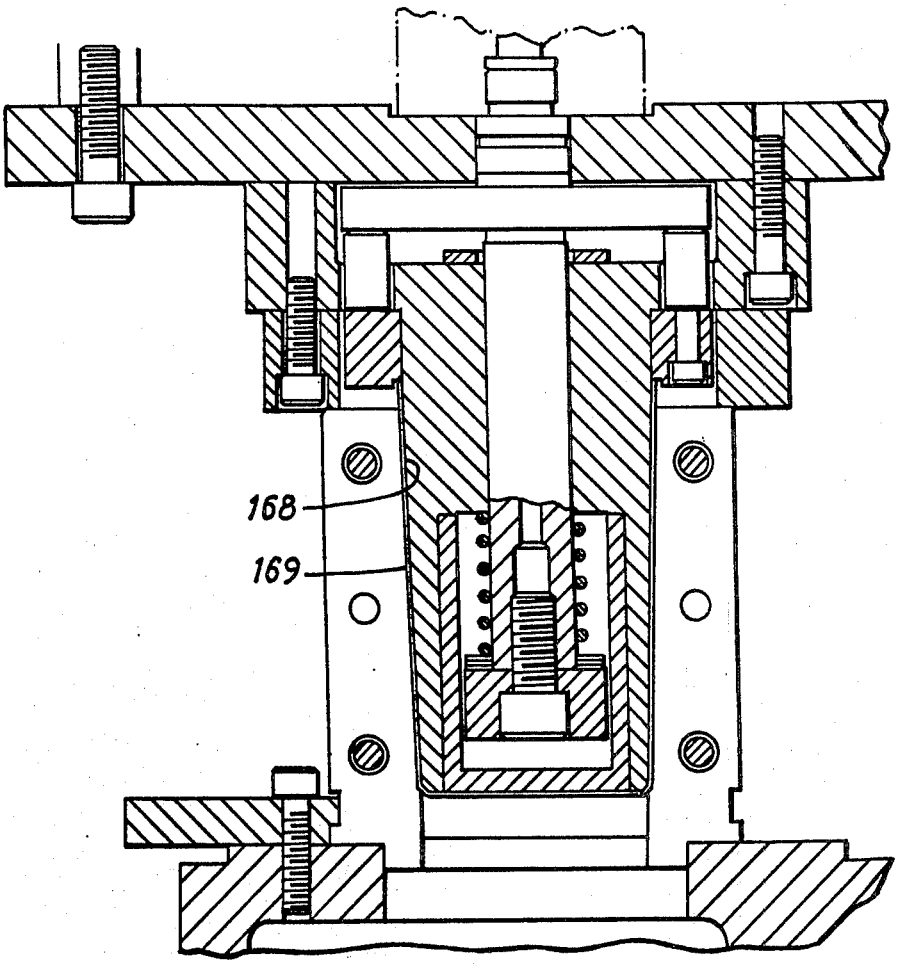
FIG. 8 shows in vertical cross-section the die and punch of the apparatus of FIG. 7 in their mated condition at the end of the drawing stroke of the punch.

FIG. 8 shows the condition of the apparatus at the end of the downward, drawing stroke of the punch, with the now tapered can body wall 166 trapped between the mating tapered working surfaces 168 and 169 of the punch 122 and die 112 respectively.

Whereas in the above descriptions, the apparatuses there described have been directed to producing can bodies having smooth, frusto-conically-shaped walls, such apparatuses may be fitted with an alternative form of die in which the internal tapered working surface of the die is constituted by a series of short, coaxially-spaced, cylindrical surfaces, each of which has a diameter greater than that of an adjacent such cylindrical surface in the direction of advancement of the punch into the die, and each of which surfaces is joined to adjacent ones by small, radially-directed steps.

Figure 9:
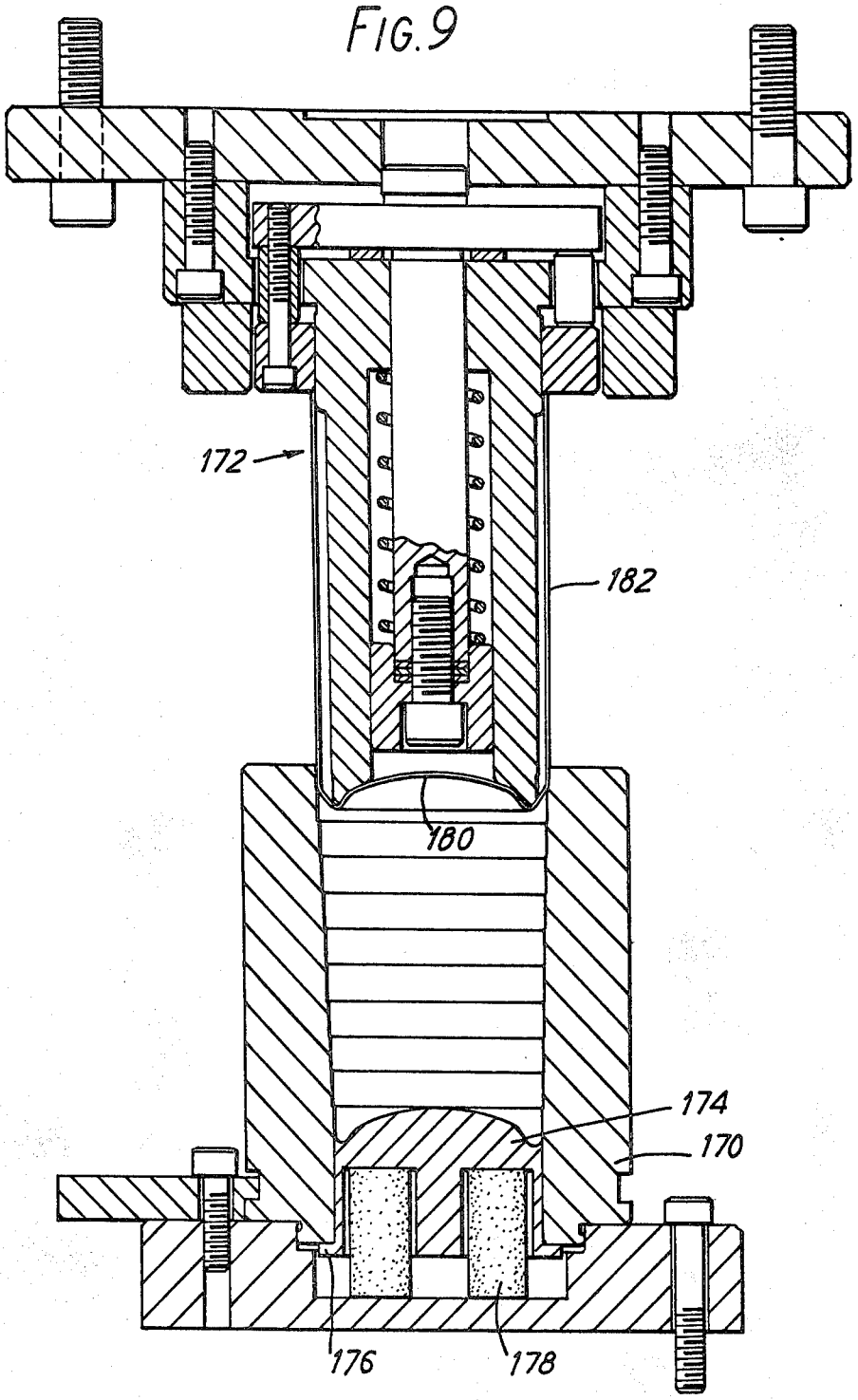
FIG. 9 shows a vertical cross-section of a third form of can body forming apparatus, with a cylindrical can body blank mounted on a punch in readiness for commencement of the drawing operation.
Figure 10:
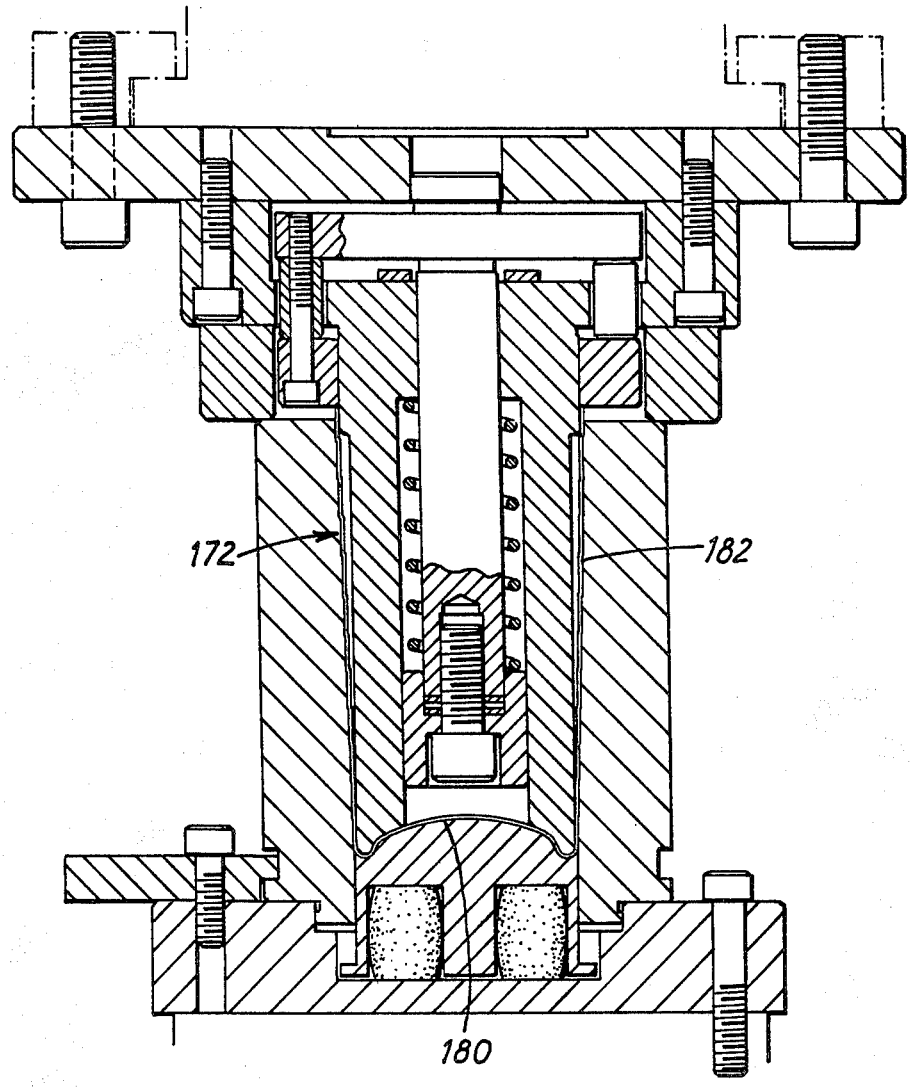
FIG. 10 shows in vertical cross-section the die and punch of the apparatus of FIG. 9 in their mated condition at the end of the drawing stroke of the punch.

Such a stepped tapered die is shown at 170 in the apparatus of FIGS. 9 and 10. In that apparatus the punch assembly 172 is generally similar to that of the FIGS. 7 and 8. At the base of the stepped tapered die 170 is a vertically-displaceable mushroom-shaped insert 174 which is slidable vertically in the base part of the die, being retained therein by an outwardly extending flange 176, and being biased to an upper position by a spring device 178. That movable insert 174 has upwardly a shape which is complementary to the shape of the base part 180 of each can body blank 182 (again shown only in vertical transverse cross-section), and is capable of deflection from its biased position as shown by an amount equal to at least the axial depth of the smallest diameter cylindrical section of the formed can body which lies adjacent to the base of the body. When after forming a can body the punch withdraws from the die, the mushroom-shaped insert 174 rises and thereby expresses the formed can body from the die.

Whereas in the FIG. 9 the punch is shown just after entering the die, in FIG. 10 the punch is shown at the end of its downward, can body forming stroke.

The particular apparatus just described, for producing stepped tapered can bodies, has been found suitable for handling can body blanks of a material thinner than that used for blanks for making smooth walled tapered can bodies with the apparatuses of FIGS. 1 to 6 and FIGS. 7 and 8 respectively. Thus, the apparatus of FIGS. 9 and 10 can satisfactorily produce stepped tapered can bodies from aluminium blanks of down to 0.14 mm thickness, whereas aluminium blanks of down to 0.20 mm thickness are used for forming smooth walled tapered can bodies in the apparatuses of FIGS. 1 to 6 and 7 and 8 respectively.

Thus, the blanks used for producing stepped wall tapered can bodies may be produced by a drawing and wall ironing (DWI) process.

The blanks for use in these methods and apparatuses must be provided with the said tapered intermediate section between the base of the blank and the cylindrical wall of the blank. That tapered intermediate section provides a proper location and entry of the blank into the die.

The proportions of that tapered intermediate section must be determined by trial and experiment. Preferably, the size of the taper of said intermediate section should be in the range of 45° to 60°, depending on the material thickness of the blank and the degree of tapering to be produced in the finished can body. An inappropriate choice of taper for that intermediate section will result in the collapse of the cylindrical wall of the blank, or in the formation of wrinkles therein during the process of forming the can body.

The methods and apparatuses described above may be adapted to produce smooth-walled tapered can bodies in which a section of the body adjacent the base is parallel-sided, the transition from that section to the smooth-walled tapered section being preferably stepped. Such a can body is shown in FIG. 11 at 184, where two cans, represented by their respective vertical half cross-sections, are shown nested together. In that figure the vertical cross-sectional shape of the can body blank before processing is also shown at 186.

FIG. 12 shows at 188 two stepped tapered wall cans, represented by their respective vertical half cross-sections, nested together; and at 190 the vertical half cross-section of the blank from which such can bodies are formed.

In FIG. 11, the respective side wall steps shown at 192 are generally frusto-conical and convergent in the direction of the closed end of the can body, and the bottom extremity 194 of the side wall (i.e. where the side wall merges with the base) of the upper can body rests on the step 192 formed in the lower can body, so that tight wedging of the upper can body within the lower can body is prevented. Preferably, the frusto-conical Sections 196 of the side walls of the respective can bodies are out of physical contact with one another.

In FIG. 12, the respective steps shown at 198 in each of the can body side walls are likewise convergent in the direction of the closed end of the can body, and the steps are spaced apart and generally dimensioned so that (a) the bottom extremity 200 of the side wall of the upper can body rests on the lowermost step 198 formed in the lower can body, and (b) each step (except the topmost) of the upper can body rests on a step of the lower can body, whereby tight wedging of the upper can body in the lower can body is prevented. Preferably, in each of said can bodies, the cylindrical portions of said side walls which adjoin each of said steps are out of contact with adjacent corresponding cylindrical portions of the side wall of the other nested can body.

With each of the can body constructions shown in the FIGS. 11 and 12, when such can bodies are nested together in vertical columns (e.g. for storage or transport) the weight of the nested can bodies supported by each particular can body is transmitted to that can body through the steps 192 or 198 formed in the side wall of that can body, and not through other parts of the can body side wall. Hence, nested can bodies are positively supported by the nested can bodies beneath them in such a way that nested can bodies can be readily separated from one another when desired.

We claim:

1. A method of forming a tapered-wall metal can body by drawing, including the steps of:

(a) producing a metal can body blank comprising a smooth generally cylindrical wall, an integral base at one end of said wall, and a trimmed free rim exposed at the opposite, open end of said wall, said rim being generally normal to said wall;

(b) advancing the can body blank, base first, into a die by means of a punch engaged inside the blank with only the base of said blank, so as to bring the said wall progressively into greater contact with a tapered internal working surface of the die;

(c) simultaneously with the step (b) applying longitudinal pressure, as well as transverse restraint, to the exposed free rim of the said wall whereby to urge the blank squarely into the tapered die, and maintaining at least that pressure, and restraint, as the blank is advanced progressively further into said tapered die; and (d) continuing the advancement of said blank by continued advancement of said punch and simultaneous application of said longitudinal pressure, and transverse restraint, to said rim, until the said wall lies uniformly against said working surface of said die throughout a desired longitudinal length of said wall.

2. A method according to claim 1, wherein said can body blank has a said integral base which merges gradually into said cylindrical wall.

3. A method according to claim 2, wherein said integral base merges into said wall by means of a short, tapered, intermediate section.

4. A method according to any preceding claim, wherein said longitudinal pressure applied to the exposed free rim of said wall is increased gradually as said blank is progressively advanced into said tapered die.

5. A method according to claim 1, 2, or 3, wherein said tapered internal working surface of said die is constituted by a series of successive sections of which the respective cross-sectional areas transverse to the direction of advancement of said blank in said die decrease progressively from one said section to the next in the direction of advancement of said blank into said die.

6. A method according to claim 5, wherein in said die each said section of said internal working surface is constituted as a cylindrical surface element which is joined to each adjacent such surface element by a step.

7. A method according to claim 5, wherein said punch has an outer working surface shaped in a manner complementary to that of said internal working surface of said die.

8. A method according to claim 6, wherein said tapered internal working surface of said die merges at its smaller end through a radially inwardly directed step into a parallel sided cylindrical die surface.

9. A method according to claim 6, wherein said internal working surface of said die is circular in a plane transverse to said direction of advancement of said blank into said die.

10. A method according to claim 1, wherein said can body blank is advanced into said tapered die by advancing said die towards said punch, said punch being held stationary.

11. A method according to claim 1, wherein said can body blank is advanced into said tapered die by advancing said punch towards said die, said die being held stationary.

12. Apparatus comprising:

(a) a tapered die having a tapered internal working surface extending longitudinally therein;

(b) a punch for receiving and advancing a can body blank longitudinally into said tapered die, said punch being arranged to engage only an internal surface of a base of said blank;

(c) driving means for effective relative advancement of said die and said punch whereby to effect advancement of a said blank received on said punch into progressively greater contact with said internal working surface of said die; and (d) pressure-applying means associated with said punch for applying, when in operation, a longitudinal pressure, and a transverse restraint, to an exposed free rim of said can body blank received on said punch as said punch is advanced longitudinally to move said can body blank into the tapered die, said pressure-applying means being operative to maintain said pressure, and restraint, until said relative advancement of said punch and die is terminated at a time when a wall of said blank lies uniformly against said internal working surface of said die throughout a desired length of said wall.

13. Apparatus according to claim 12, wherein said pressure-applying means comprises a collar arranged for longitudinally sliding on said punch, said collar having a rim supporting surface for receiving and supporting a said exposed free rim of a said can body blank when received on said punch, and collar supporting means for supporting said collar at a longitudinal position on said punch such that when said exposed free rim of said can body blank is seated on and supported by said rim supporting surface prior to advancement of said blank into said die, said punch abuts internally against said base of said blank.

14. Apparatus according to claim 13, wherein said collar supporting means includes a resilient biasing means which becomes progressively compressed by said collar as said punch advances a said blank into said tapered die, thereby causing said longitudinal pressure applied to said exposed free rim of said blank to progressively increase as said punch advances into said die.

15. Apparatus according to claim 13 or claim 14, wherein said collar is provided with a controllable actuator for effecting advancement of said collar along said punch whereby to place said can body, after withdrawal of said punch from said die and said can body, in an exit position free of said punch and said die and ready for removal to another station.

16. Apparatus according to claim 15, wherein said collar carries externally thereon a guide ring having guide members extending longitudinally therefrom for receiving and positioning an incoming can body blank to position said blank for a can-forming relative advancement of said punch and said die.

17. Apparatus according to claim 16, wherein said guide ring is free to slide longitudinally on said collar, and is resiliently biased to a blank receiving and positioning position, whereby relative advancement of said punch and said die resiliently displaces said guide ring against said biasing means.

18. Apparatus according to claim 17, including a blank-clamping member slidably mounted relative to said die for axial movement through a tapered bore of said die, and biasing means urging said clamping member to a bias position disposed at an entrance to said die, whereby on relative movement of said die and punch to advance a can body blank into the bore of said die, said blank clamping member urges the base of said blank received on said punch against a nose of said punch and thereby holds said base firmly during the drawing of the wall of the said blank in said die.

19. An apparatus according to claim 18, wherein said tapered internal working surface of said die is divided into a series of longitudinally successive sections of which the cross-sectional areas transverse to the direction of advancement of said blank in said die decrease progressively from one such section to the next in the said direction of advancement of said blank.

20. An apparatus according to claim 19, wherein in said die each said section of said internal working surface is constituted as a cylindrical surface element, joined to each adjacent such surface element by a step.

21. An apparatus according to claim 19, wherein said punch has an outer working surface shaped in a manner complementary to that of the internal working surface of said die.

22. An apparatus according to claim 12, wherein said tapered internal working surface of said die merges at its smaller end through a radially-inwardly directed step into a right cylindrical die surface.

23. An apparatus according to claim 12, wherein said punch is held stationary, and said driving means is arranged to effect advancement of said die towards said stationary punch.

24. An apparatus according to claim 12, wherein said tapered die is held stationary, and said driving means is arranged to effect advancement of said punch towards said stationary die.

* * * * *